US008095035B2

(12) United States Patent
Ooyoshi et al.

(10) Patent No.: US 8,095,035 B2
(45) Date of Patent: Jan. 10, 2012

(54) DEVELOPING DEVICE, PROCESS UNIT, AND IMAGE FORMING APPARATUS, WITH SUPPORTING MEMBERS, GROOVES, AND SUPPORTED DEVELOPING ROLLER

(75) Inventors: Hirobumi Ooyoshi, Osaka (JP); Osamu Saito, Osaka (JP); Yoshihiro Kawakami, Hyogo (JP); Kenzo Tatsumi, Osaka (JP); Tomohiro Kubota, Osaka (JP); Yoshiyuki Shimizu, Hyogo (JP); Tomofumi Yoshida, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 490 days.

(21) Appl. No.: 12/334,610

(22) Filed: Dec. 15, 2008

(65) Prior Publication Data

US 2009/0169246 A1 Jul. 2, 2009

(30) Foreign Application Priority Data

Dec. 28, 2007 (JP) ..... 2007-339846

(51) Int. Cl.
*G03G 21/00* (2006.01)

(52) U.S. Cl. ..... 399/111

(58) Field of Classification Search ..... 399/111, 399/107, 110, 119
See application file for complete search history.

(56) References Cited

U.S. PATENT DOCUMENTS

| | | | | |
|---|---|---|---|---|
| 2007/0104523 | A1 | 5/2007 | Yoshida et al. | |
| 2007/0140763 | A1 | 6/2007 | Shimizu et al. | |
| 2007/0248390 | A1 | 10/2007 | Kubota et al. | |
| 2008/0019720 | A1 | 1/2008 | Kawakami et al. | |
| 2008/0089727 | A1 | 4/2008 | Shimizu et al. | |
| 2008/0095559 | A1 | 4/2008 | Shimizu et al. | |
| 2008/0145108 | A1 | 6/2008 | Yoshida et al. | |
| 2008/0145109 | A1 | 6/2008 | Murayama et al. | |
| 2008/0145119 | A1 | 6/2008 | Tatsumi et al. | |
| 2008/0152408 | A1 | 6/2008 | Kawakami et al. | |
| 2008/0170898 | A1 | 7/2008 | Shimizu et al. | |
| 2008/0181692 | A1 | 7/2008 | Tatsumi et al. | |
| 2008/0187358 | A1 | 8/2008 | Kubota et al. | |
| 2008/0205930 | A1 | 8/2008 | Kawakami et al. | |
| 2008/0219698 | A1 | 9/2008 | Shimizu et al. | |
| 2008/0219710 | A1* | 9/2008 | Kweon | 399/281 |
| 2008/0267661 | A1 | 10/2008 | Yoshida et al. | |
| 2008/0279586 | A1 | 11/2008 | Tatsumi et al. | |
| 2008/0317513 | A1* | 12/2008 | Sakagawa et al. | 399/281 |

FOREIGN PATENT DOCUMENTS

| | | | |
|---|---|---|---|
| JP | 63-88861 | | 6/1988 |
| JP | 63163474 | A * | 7/1988 |
| JP | 11-249481 | | 9/1999 |
| JP | 2003167431 | A * | 6/2003 |
| JP | 2006-171295 | | 6/2006 |
| JP | 2007133248 | A * | 5/2007 |

OTHER PUBLICATIONS

Computer translation of JP2003-167431A, Jun. 13, 2003.*

* cited by examiner

*Primary Examiner* — Quana M Grainger
(74) *Attorney, Agent, or Firm* — Dickstein Shapiro LLP

(57) ABSTRACT

A developing device includes a main body that is arranged between a pair of supporting members and includes a developing roller. Both end portions of the developing roller are supported by the supporting members in a first direction in which the developing roller is movable toward and away from an image carrier. A groove is formed on each of the supporting members. Either one of an end portion of the developing roller and a bearing that supports the end portion is inserted into the groove. Either one of at least one of the end portions of the developing roller and at least one of the bearings is movable in the groove in a second direction that intersects the first direction.

15 Claims, 7 Drawing Sheets

PRIOR ART

DEVELOPING DEVICE, PROCESS UNIT, AND IMAGE FORMING APPARATUS, WITH SUPPORTING MEMBERS, GROOVES, AND SUPPORTED DEVELOPING ROLLER

CROSS-REFERENCE TO RELATED APPLICATIONS

The present application claims priority to and incorporates by reference the entire contents of Japanese priority document 2007-339846 filed in Japan on Dec. 28, 2007.

BACKGROUND OF THE INVENTION

1. Field of the Invention

The present invention relates to a developing device, a process unit including the developing device, and an image forming apparatus.

2. Description of the Related Art

FIG. 9 is a schematic diagram of a developing device 30 included in a conventional image forming apparatus, such as a copier, a printer, a facsimile, or a multifunction product (MFP). As shown in FIG. 9, the developing device 30 includes a developing roller 5, a supplying roller 31, a blade 32, a toner hopper 6, and a toner stirring member 33.

The supplying roller 31 includes a sponge layer to obtain toner on its outer circumference. The supplying roller 31 is rotated in the same direction as that of the developing roller 5, so that the supplying roller 31 supplies toner from the sponge layer to the developing roller 5. The blade 32 is, for example, a blade spring made of a metal. An end of the blade 32 is in pressure contact with the surface of the developing roller 5 whereby the toner on the surface of the developing roller 5 is formed into a thin layer having a uniform thickness. The toner stirring member 33 is rotatably mounted in the toner hopper 6. The toner stirring member 33 is rotated to stir toner T contained in the toner hopper 6. The developing roller 5 includes a rubber layer on its outer circumference. The surface of the developing roller 5 is in contact with the surface of an image carrier 2 (photosensitive element). The developing roller 5 transfers the toner from its surface to the surface of the image carrier 2 whereby a toner image is formed on the surface of the image carrier 2.

To prevent uneven image density and image loss, it is necessary to transfer the toner from the surface of the developing roller 5 to the surface of the image carrier 2 at a uniform density. Therefore, the image carrier 2 and the developing roller 5 need to be in contact with each other at a uniform contact pressure. If the developing roller 5 is moved away from the image carrier 2 and is not in contact with the image carrier 2, the toner cannot be transferred from the surface of the developing roller 5 to the surface of the image carrier 2, which results in the image loss. On the other hand, if the developing roller 5 is moved too close to the image carrier 2 and is pressed against the image carrier 2 at a high pressure, this causes a high image density.

Japanese Patent Application Laid-open No. 2006-171295 discloses a technology for biasing a developing roller toward an image carrier by using a biasing member such as a spring, so that the developing roller is in contact with the image carrier at a uniform contact pressure.

FIGS. 10A and 10B are schematic diagrams for explaining movement of the developing roller 5 and the image carrier 2. In FIG. 10A, the rotation axis of the image carrier 2 is located close to the rotation axis of the developing roller 5, and in FIG. 10B, the rotation axis of the image carrier 2 is located apart from the rotation axis of the developing roller 5. As shown in FIG. 10A, the developing roller 5 can be moved toward and away from the image carrier 2, and a bearing 34 is attached to each end of the rotation axis of the developing roller 5. A biasing member 35 such as a spring presses the bearing 34 toward the image carrier 2, so that the developing roller 5 is pressed against the image carrier 2.

Although each of the developing roller 5 and the image carrier 2 is eccentric, a distance between the image carrier 2 (the rotation axis of the image carrier 2) and the developing roller 5 (the rotation axis of the developing roller 5) can be adjusted by moving the developing roller 5 toward and away from the image carrier 2. Specifically, the distance between the image carrier 2 and the developing roller 5 can be made short like a distance D1 shown in FIG. 10A, or can be made long like a distance D2 shown in FIG. 10B. Thus, even if the developing roller 5 or the image carrier 2 does not have a perfect circle shape or is eccentric, it is possible to maintain a uniform contact pressure between the developing roller 5 and the image carrier 2.

Furthermore, if the contact pressure between the developing roller 5 and the image carrier 2 is made small, it is possible to reduce rotary torque of the image carrier 2 and the developing roller 5 and prevent toner deterioration caused by friction between the developing roller 5 and the image carrier 2.

A conventional image forming apparatus includes a process unit having an image carrier, a charging unit, a developing device, and a cleaning unit that are integrally contained in a casing. The process unit is detachably attached to a main body of the image forming apparatus. The process unit is detached from the main body of the image forming apparatus, so that a maintenance work can be easily performed.

FIG. 11 is an exploded perspective view of a process unit 1. The process unit 1 includes the developing device 30, the image carrier 2, and a pair of supporting members 50*a* and 50*b*. The supporting members 50*a* and 50*b* support the developing device 30 and the image carrier 2. Holes 51*a* and 51*b* are formed on lower portions of the supporting members 50*a* and 50*b*, respectively, to insert both ends 2*a* and 2*b* of the rotation axis of the image carrier 2. Long holes 52*a* and 52*b* are formed on upper portions of the supporting members 50*a* and 50*b*, respectively. The long holes 52*a* and 52*b* extend in a first direction that extends toward and away from the image carrier 2 (the holes 51*a* and 51*b*).

Guides 54*a* and 54*b* each having a U-shape are arranged on the supporting members 50*a* and 50*b*, respectively. The guides 54*a* and 54*b* extend in the first direction. Bearings 34*a* and 34*b* are arranged in grooves of the guides 54*a* and 54*b*, respectively. Each of the bearings 34*a* and 34*b* is movable in the corresponding groove. Biasing members 35*a* and 35*b* are arranged in the grooves of the guides 54*a* and 54*b*, respectively. The biasing members 35*a* and 35*b* bias the bearings 34*a* and 34*b* toward the holes 51*a* and 51*b*.

The developing roller 5 is arranged on a lower portion of a main body 37 of the developing device 30. Moreover, a pair of projected portions (bosses) 36*a* and 36*b* is arranged on upper side surfaces of the main body 37.

To assemble the above components of the process unit 1, the ends 2*a* and 2*b* are inserted through the holes 51*a* and 51*b*, respectively. Furthermore, both ends 5*a* and 5*b* of the developing roller 5 are inserted into the bearings 34*a* and 34*b*, and the projected portions 36*a* and 36*b* are inserted through the long holes 52*a* and 52*b*, so that the main body 37 is attached to the supporting members 50*a* and 50*b*. Retaining members 53*a* and 53*b* such as screws are attached to ends of the projected portions 36*a* and 36*b* that are laterally protruded through the long holes 52*a* and 52*b*. Thus, the supporting members 50*a* and 50*b* are prevented from being detached from the main body 37.

When the components of the process unit 1 are assembled in the above manner, the developing roller 5 is pressed against the surface of the image carrier 2 by biasing forces of the biasing members 35*a* and 35*b*.

Because the projected portions 36*a* and 36*b* and the rotation axis of the developing roller 5 are arranged near opposite ends (the upper end and the lower end) of the main body 37, the main body 37 is supported by the supporting members 50*a* and 50*b* in a stable manner.

FIG. 12 is a schematic diagram for explaining a process of attaching the process unit 1 to a main body 60 of the image forming apparatus. The main body 60 includes side walls 61*a* and 61*b* facing each other with a predetermined distance, and grooves 62*a* and 62*b* are formed on the side walls 61*a* and 61*b*, respectively, in the longitudinal direction.

To attach the process unit 1 to the main body 60, the ends 2*a* and 2*b* protruding through the supporting members 50*a* and 50*b* are inserted into the grooves 62*a* and 62*b*. When the ends 2*a* and 2*b* are brought into contact with lower ends of the grooves 62*a* and 62*b*, the position of the process unit 1 is set with respect to the main body 60.

If the image carrier 2 and the developing roller 5 are rotated when the process unit 1 is attached to the main body 60, the bearings 34*a* and 34*b* are moved inside the guides 54*a* and 54*b*, so that the developing roller 5 (the rotation axis of the developing roller 5) can be moved toward and away from the image carrier 2 (the rotation axis of the image carrier 2). Moreover, the projected portions 36*a* and 36*b* are moved inside the long holes 52*a* and 52*b* with the movement of the developing roller 5 toward and away from the image carrier 2.

When the process unit 1 is attached to the main body 60, it is possible that the supporting members 50*a* and 50*b* are twisted in directions indicated by arrows A and B in FIG. 11 due to a dimension tolerance or an assembly error of the components of the process unit 1, a dimension tolerance of the grooves 62*a* and 62*b* formed in the main body 60, or the like. Specifically, the supporting members 50*a* and 50*b* are circumferentially twisted around the rotation axis of the image carrier 2 in opposite directions to each other.

When the supporting members 50*a* and 50*b* are twisted with respect to each other, the ends 5*a* and 5*b* and the projected portions 36*a* and 36*b* are moved with the movement of the supporting members 50*a* and 50*b* in the opposite directions. FIG. 13 is a perspective view for explaining a state of the developing roller 5 that is tilted with respect to the image carrier 2. Specifically, the axis line of the developing roller 5 is tilted with respect to the axis line of the image carrier 2.

FIG. 14 is a side view of the developing roller 5 and the image carrier 2 from the axial direction of the image carrier 2 for explaining states of the developing roller 5 that is tilted with respect to the image carrier 2. When the axis line of the developing roller 5 is tilted with respect to the axis line of the image carrier 2, distances D3 and D4 between the rotation axis of the image carrier 2 and the rotation axis of the developing roller 5 at both areas SL and SR are longer than a distance D5 between the rotation axis of the image carrier 2 and the rotation axis of the developing roller 5 at a middle area 5M. Therefore, the contact pressure between the developing roller 5 and the image carrier 2 at each of the areas SL and SR is smaller than that at the middle area 5M. Furthermore, when an amount of twist of the supporting members 50*a* and 50*b* is large, or a spring having a relatively small biasing force is used as the biasing member of the developing roller 5, the developing roller 5 cannot be in contact with the surface of the image carrier 2 at the areas SL and SR. As described above, the developing roller 5 cannot be in contact with the image carrier 2 at a uniform contact pressure in the axial direction, which results in the uneven image density and the image loss.

To prevent the uneven image density and the image loss, in a conventional image forming apparatus, a soft rubber is applied to a rubber layer of a developing roller. With this configuration, when the developing roller is tilted with respect to an image carrier, because a middle portion of the rubber layer that is pressed against the image carrier is largely deformed, both ends of the developing roller can be in contact with the image carrier. However, in this technology, there is a limitation on a type of rubber that can be applied to the rubber layer, and because the middle portion of the rubber layer is largely deformed, the high image density is caused at the middle portion of the developing roller.

As an alternative way of preventing the uneven image density and the image loss, the biasing force applied to a developing roller is made large, and a middle portion of a rubber layer that is pressed against an image carrier is largely deformed. However, in the same manner as the above technology, this technology also causes the high image density at the middle portion of the developing roller. Moreover, when the biasing force of the developing roller is large, it is difficult to reduce the rotary torque of the developing roller and prevent toner deterioration.

SUMMARY OF THE INVENTION

It is an object of the present invention to at least partially solve the problems in the conventional technology.

According to one aspect of the present invention, there is provided a developing device including a main body that is arranged between a pair of supporting members and includes a developing roller. Both end portions of the developing roller are supported by the supporting members, respectively, in a first direction in which the developing roller is movable toward and away from an image carrier. A groove is formed on each of the supporting members. Either one of an end portion of the developing roller and a bearing that supports the end portion is inserted into the groove. Either one of at least one of the end portions of the developing roller and at least one of the bearings is movable in the groove in a second direction that intersects the first direction.

Furthermore, according to another aspect of the present invention, there is provided a process unit including a pair of supporting members that is detachably attached to a main body of an image forming apparatus. The supporting members integrally support a developing device and an image carrier. The developing device includes a main body that is arranged between the supporting members and that includes a developing roller. Both end portions of the developing roller are supported by the supporting members, respectively, in a first direction in which the developing roller is movable toward and away from the image carrier. A groove is formed on each of the supporting members. Either one of an end portion of the developing roller and a bearing that supports the end portion is inserted into the groove. Either one of at least one of the end portions of the developing roller and at least one of the bearings is movable in the groove in a second direction that intersects the first direction.

Moreover, according to still another aspect of the present invention, there is provided an image forming apparatus including a developing device. The developing device includes a main body that is arranged between a pair of supporting members and includes a developing roller. Both end portions of the developing roller are supported by the supporting members, respectively, in a first direction in which the developing roller is movable toward and away from an image carrier. A groove is formed on each of the supporting members. Either one of an end portion of the developing roller and a bearing that supports the end portion is inserted into the groove. Either one of at least one of the end portions of the developing roller and at least one of the bearings is movable in the groove in a second direction that intersects the first direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
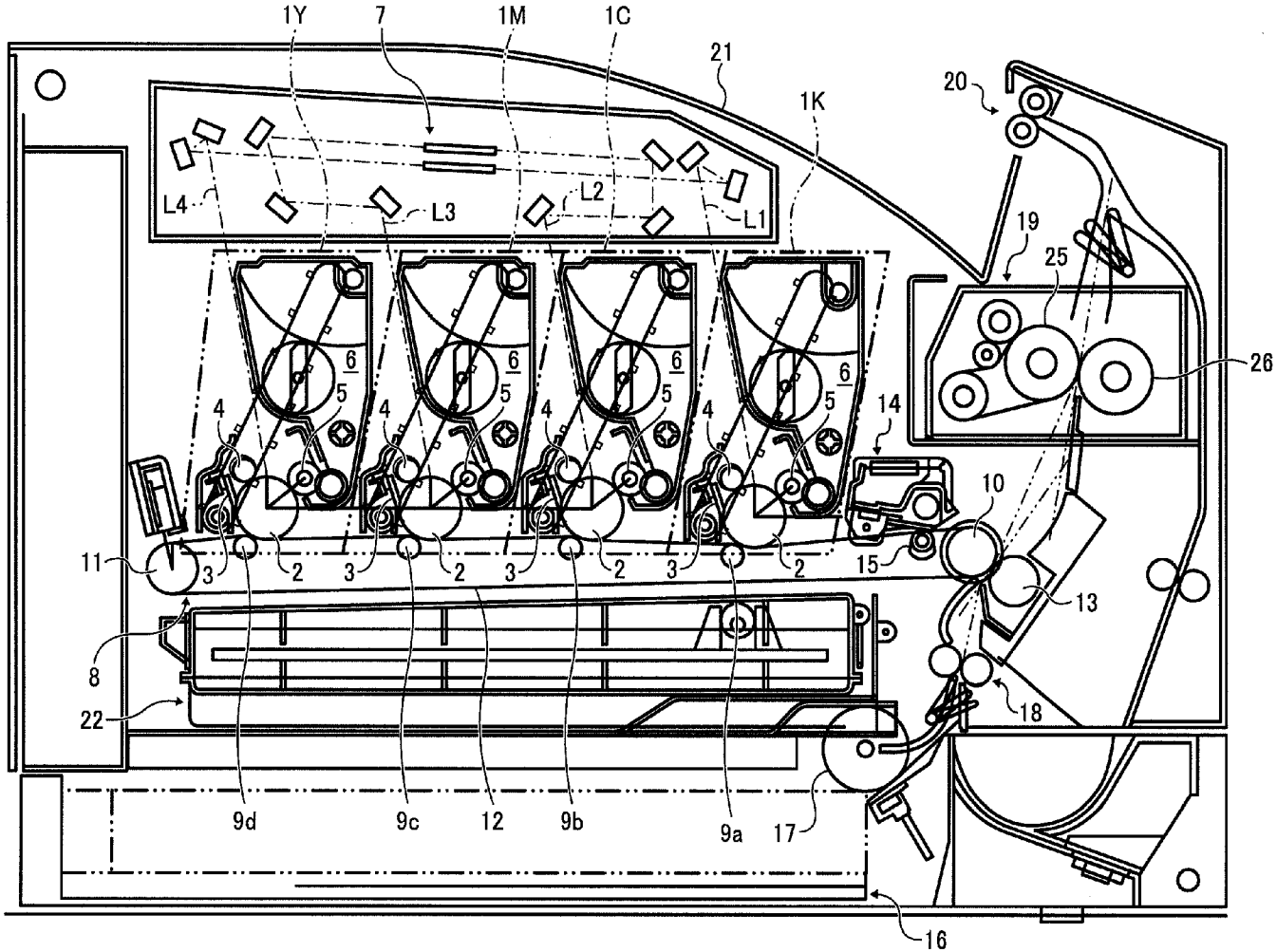
FIG. 1 is a schematic diagram of an image forming apparatus according to an embodiment of the present invention.

FIG. 1 is a schematic diagram of an image forming apparatus according to an embodiment of the present invention. The image forming apparatus includes four process units 1K, 1C, 1M, and 1Y. The process units 1K, 1C, 1M, and 1Y include image forming units to form a color image by using developers containing toners of four primary colors, i.e., black, cyan, magenta, and yellow.

The process units 1K, 1C, 1M, and 1Y have the same configuration except that they contain toner of different colors. The configuration and operation of the process unit 1K will be described as an example in detail. The process unit 1K includes the image carrier 2, a cleaning unit 3, a charging unit 4, the developing roller 5, and the toner hopper 6. The process unit 1K is detachably attached to a main body of the image forming apparatus.

An exposure device 7 is arranged above the process units 1K, 1C, 1M, and 1Y. The exposure device 7 causes laser diodes (not shown) to emit four laser beams L1 to L4 corresponding to the four process units 1K, 1C, 1M, and 1Y based on image data.

A transfer belt device 8 is arranged under the process units 1K, 1C, 1M, and 1Y. The transfer belt device 8 includes an intermediate transfer belt 12 to transfer a toner image formed on the image carrier 2. The intermediate transfer belt 12 is supported and rotated by four primary transfer rollers 9*a*, 9*b*, 9*c*, 9*d*, a drive roller 10, a supporting roller 11, and a cleaning backup roller 15. The primary transfer rollers 9*a*, 9*b*, 9*c*, and 9*d* are arranged parallel to the image carriers 2 of the process units 1K, 1C, 1M, and 1Y. A secondary transfer roller 13 is arranged parallel to the drive roller 10. A belt cleaning device 14 is arranged parallel to the cleaning backup roller 15.

A feeding cassette 16 and a feeding roller 17 are arranged at the bottom of the image forming apparatus. The feeding cassette 16 can contain one or more sheets (hereinafter, "recording media"). The feeding roller 17 feeds a recording medium from the feeding cassette 16. A pair of registration rollers 18 is arranged between the feeding roller 17 and a transfer nip formed between the secondary transfer roller 13 and the drive roller 10. The registration rollers 18 temporarily stop a recording medium that is fed to them by the feeding roller 17.

A fixing device 19 is arranged above the transfer nip formed between the secondary transfer roller 13 and the drive roller 10. The fixing device 19 includes a fixing roller 25, a pressure roller 26. A pair of discharging rollers 20 is arranged above the fixing device 19. The discharging rollers 20 discharge a recording medium out of the image forming apparatus. Recording media discharged by the discharging rollers 20 are stacked on a catch tray 21 that is formed by curving a part of the upper surface of the main body of the image forming apparatus in an inward direction.

A waste-toner container 22 is arranged between the transfer belt device 8 and the feeding cassette 16. A waste-toner conveying hose (not shown) extends from the belt cleaning device 14 to an inlet of the waste-toner container 22.

When the feeding roller 17 is rotated based on a feed signal input from a control unit (not shown) included in the image forming apparatus, the feeding roller 17 feeds a recording medium that is on the top of a pile of stacked recording media from the feeding cassette 16 toward the registration rollers 18. When a leading end of the fed recording medium reaches a nip between the registration rollers 18, the registration rollers 18 temporarily stop the recording medium to synchronize the timing of conveying the recording medium with the timing of transferring the toner image formed on the intermediate transfer belt 12.

An image forming process performed by the process unit 1K will be described as an example in detail. The charging unit 4 uniformly charges the surface of the image carrier 2 to a high electric potential. A portion of the surface of the image carrier 2 is irradiated with the laser beam L1 emitted from the exposure device 7 based on image data. An electric potential of the irradiated portion then decreases whereby an electrostatic latent image is formed on the portion. The developing roller 5 applies black toner fed from the toner hopper 6 to the electrostatic latent image formed on the image carrier 2 thereby forming (developing) a black toner image. The toner image formed on the image carrier 2 is then primary-transferred to the intermediate transfer belt 12. The other process units 1C, 1M, and 1Y perform the same process as described above to form cyan, magenta, and yellow toner images on the image carriers 2. The toner images of the four colors are transferred onto the intermediate transfer belt 12 in a superimposed manner.

The cleaning unit 3 of each of the process units 1K, 1C, 1M, and 1Y removes toner remaining on the surface of the image carrier 2 after the process of transferring the toner image to the intermediate transfer belt 12 is finished. After the cleaning unit 3 removes the toner from the surface of the image carrier 2, a charge removing device (not shown) removes residual charge from the image carrier 2.

Then, the registration rollers 18 and the feeding roller 17 start to rotate again thereby feeding the recording medium toward the secondary transfer roller 13 in such a manner that the timing of conveying the recording medium is synchronized with the timing of transferring a color toner image formed on the intermediate transfer belt 12. The secondary transfer roller 13 then secondary-transfers the color toner image from the intermediate transfer belt 12 to the recording medium.

The recording medium with the color toner image is conveyed to the fixing device 19. The recording medium is then sandwiched between the fixing roller 25 and the pressure roller 26, so that the unfixed color toner image is fixed to the recording medium with heat and pressure. The recording medium with the fixed color toner image is conveyed from the fixing device 19 to the discharging rollers 20, and then discharged to the catch tray 21 by the discharging rollers 20.

After the color toner image is transferred from the intermediate transfer belt 12 to the recording medium, some toner remains on the intermediate transfer belt 12. The belt cleaning device 14 removes the toner from the intermediate transfer belt 12. The toner removed from the intermediate transfer belt 12 is conveyed to the waste-toner container 22 by a waste-toner conveying unit (not shown), and is collected in the waste-toner container 22.

Figure 9:
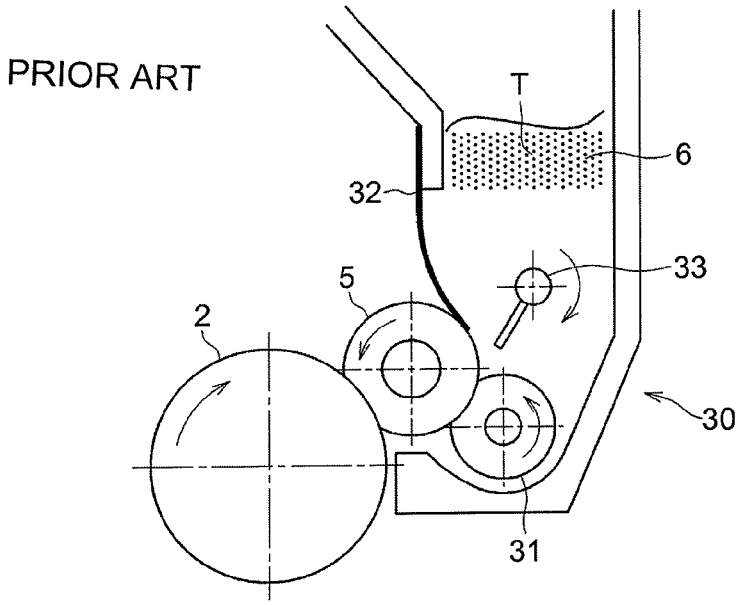
FIG. 9 is a schematic diagram of the developing device.
Figure 10A:
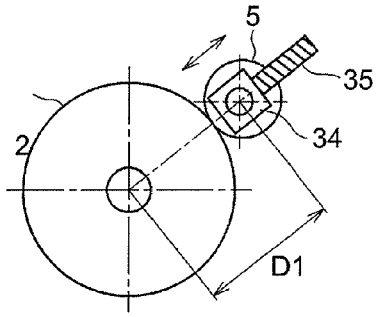
PRIOR ART FIG.10A
FIGS. 10A and 10B are schematic diagrams for explaining movement of a developing roller and an image carrier according to a conventional technology.
Figure 10B:
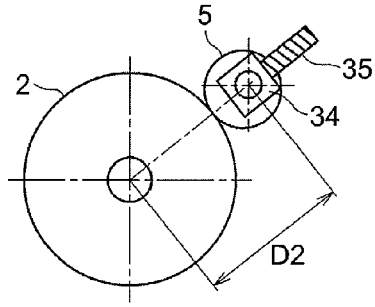
PRIOR ART FIG.10B

The process units 1K, 1C, 1M, and 1Y have the same basic configuration as that of the process unit 1. Each of the process units 1K, 1C, 1M, and 1Y includes the developing device 30, the image carrier 2, and the supporting members 50*a* and 50*b*. In the same manner as the developing device 30 shown in FIG. 9, the developing device 30 according to the embodiment includes the developing roller 5, the supplying roller 31, the blade 32, the toner hopper 6, and the toner stirring member 33.

Figure 2:
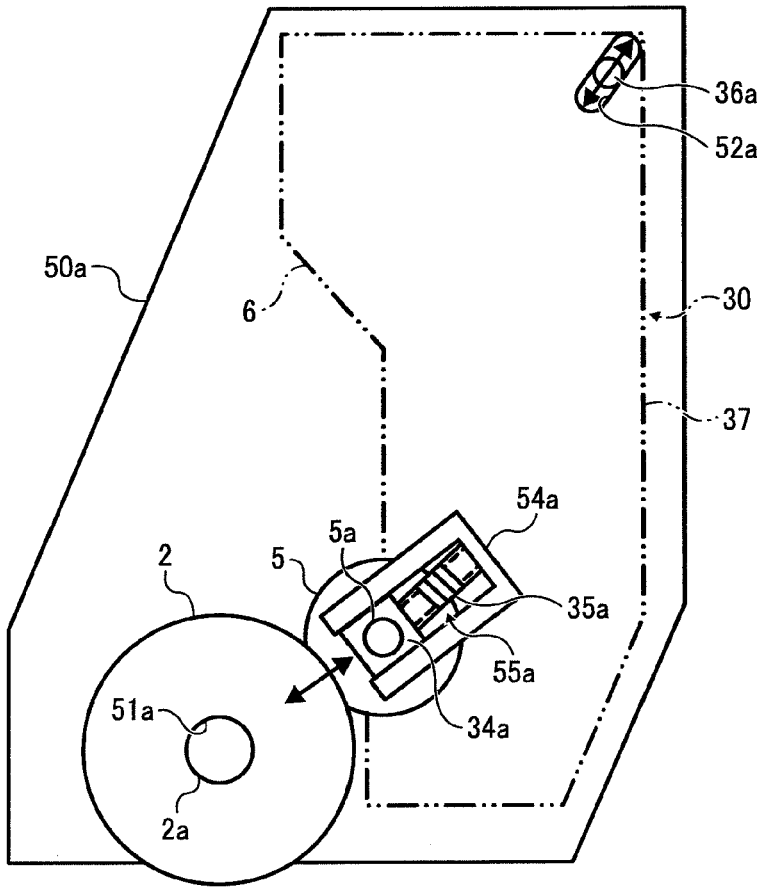
FIG. 2 is a side view of one of supporting members included in a process unit of the image forming apparatus according to the embodiment.

FIG. 2 is a side view of the supporting member 50*a* supporting the developing device 30 and the image carrier 2 according to the embodiment. The hole 51*a* is formed on the lower portion of the supporting member 50*a* to insert the end 2*a*. The long hole 52*a* extending in the first direction is formed on the upper portion of the supporting member 50*a*. On the other hand, the projected portions 36*a* having a round-bar shape is arranged on the upper side surface of the main body 37, and is inserted through the long hole 52*a*.

The guide 54*a* extending in the first direction is arranged on the inner surface of the supporting member 50*a* facing the developing device 30.

The first direction in which each of the long hole 52*a* and the guide 54*a* extends is not necessarily a linear direction passing through the rotation center of the image carrier 2 (the center of the hole 51*a*). Specifically, an extended line in the longitudinal direction of each of the long hole 52*a* and the guide 54*a* can be located at a different position from the rotation center of the image carrier 2 (the center of the hole 51*a*).

The bearing 34*a* is arranged in a groove 55*a* of the guides 54*a* to support the end 5*a*. The bearing 34*a* is movable in the groove 55*a* in its longitudinal direction. Furthermore, the biasing member 35*a* is arranged in the groove 55*a* to bias the bearing 34*a* toward the image carrier 2 (the hole 51*a*). The biasing member 35*a* is, for example, a coil spring, and ends of the biasing member 35*a* are attached to the guide 54*a* and the bearing 34*a*.

Figure 3A:
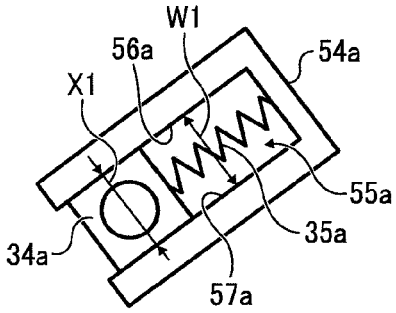
FIGS. 3A and 3B are enlarged views of relevant parts of the supporting member shown in FIG. 2.
Figure 3B:
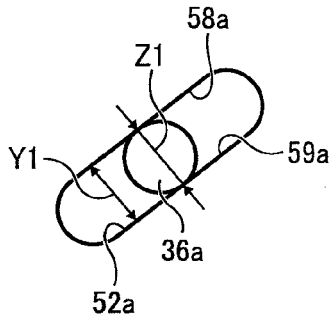

FIG. 3A is an enlarged view of the bearing 34*a* and the guide 54*a*, and FIG. 3B is an enlarged view of the projected portion 36*a* and the long hole 52*a*. As shown in FIG. 3A, a width W1 of the groove 55*a* in a direction perpendicular to its longitudinal direction is set to be substantially the same as a width X1 of the bearing 34*a*. Although it is described above that the width W1 is set to be substantially the same as the width X1, it can mean that the width W1 and the width X1 are set to be completely the same, and the width X1 is slightly smaller than the width W1. Specifically, a small space (for example, about 0.1 mm) is provided between each of inner surfaces 56*a* and 57*a* facing each other in a longitudinal direction of the guide 54*a* and the outer surface of the bearing 34*a*. Thus, the bearing 34*a* can be smoothly moved in the groove 55*a* in the longitudinal direction (the first direction).

As shown in FIG. 3B, a width Y1 of the long hole 52*a* in a direction perpendicular to its longitudinal direction is set to be substantially the same as a diameter (width) Z1 of the projected portion 36*a*. In the same manner as described above, a small space is provided between each of inner surfaces 58*a* and 59*a* facing each other in a longitudinal direction of the long hole 52*a* and the outer surface of the projected portion 36*a*, so that the projected portion 36*a* can be smoothly moved in the long hole 52*a* in the longitudinal direction (the first direction).

Figure 4:
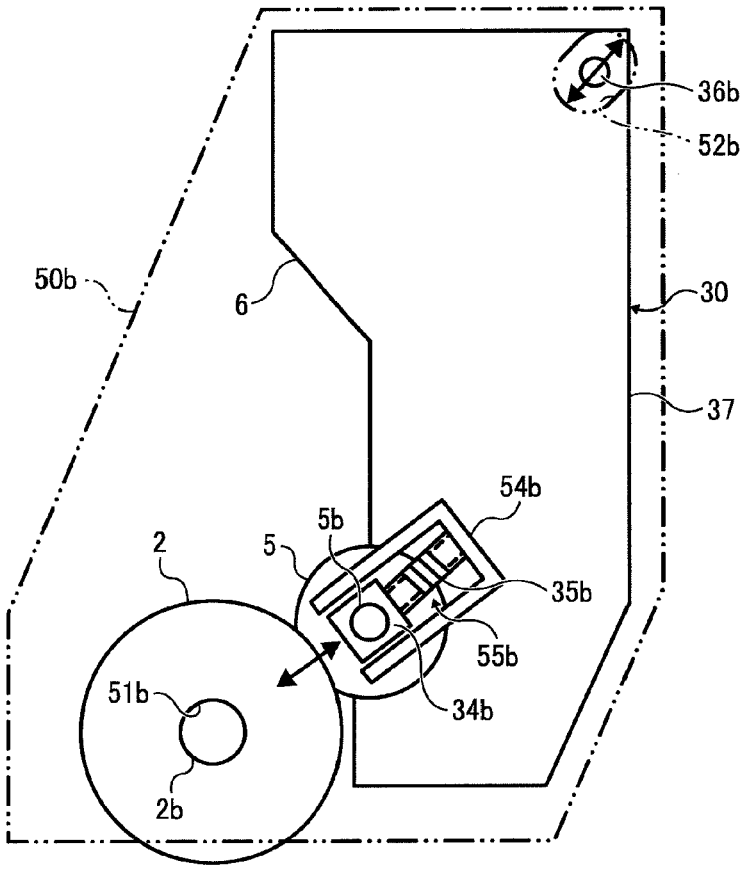
FIG. 4 is a side view of the other one of the supporting members included in the process unit according to the embodiment.

FIG. 4 is a side view of the supporting member 50*b* supporting the developing device 30 and the image carrier 2 according to the embodiment. The supporting structure of the supporting member 50*b* that is different from that of the supporting member 50*a* shown in FIG. 2 will be described in detail below.

Although the long hole 52*b* is formed on the upper portion of the supporting member 50*b* to insert the projected portion 36*b*, the projected portion 36*b* is inserted through the long hole 52*b* such that the projected portion 36*b* is not in contact with the inner surface of the long hole 52*b*. Furthermore, although the guide 54*b* including the bearing 34*b* is arranged on the supporting member 50*b*, the bearing 34*b* is not in contact with the inner surface of the guide 54*b*.

Figure 5A:
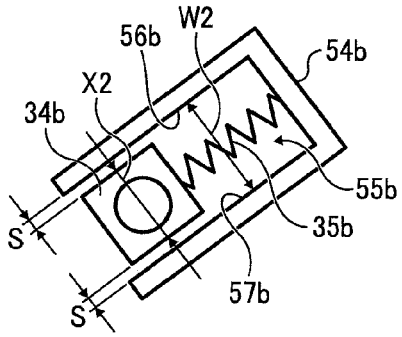
FIGS. 5A and 5B are enlarged views of relevant parts of the supporting member shown in FIG. 4.
Figure 5B:
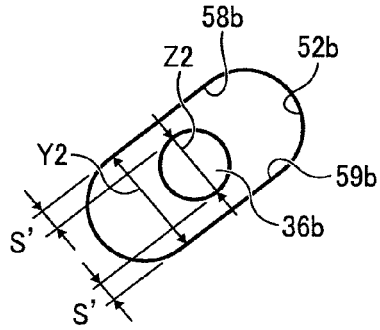

FIG. 5A is an enlarged view of the bearing 34*b* and the guide 54*b*, and FIG. 5B is an enlarged view of the projected portion 36*b* and the long hole 52*b*. As shown in FIG. 5A, a width W2 of a groove 55*b* of the guide 54*b* in a direction perpendicular to its longitudinal direction is set to be larger than a width X2 of the bearing 34*b*. A predetermined space S (for example, about 0.25 mm) is provided between each of inner surfaces 56*b* and 57*b* facing each other in a longitudinal direction of the guide 54*b* and the outer surface of the bearing 34*b*.

As shown in FIG. 5B, a width Y2 of the long hole 52*b* in a direction perpendicular to its longitudinal direction is set to be larger than a diameter (width) Z2 of the projected portion 36*b*. A space S1 is provided between each of inner surfaces 58*b* and 59*b* facing each other in a longitudinal direction of the long hole 52*b* and the outer surface of the projected portion 36*b*. The space S1 is set to be larger than the space S.

Each of the grooves 55*a* and 55*b* can be a hole having a bottom formed on the supporting member, a through hole, or the like, rather than the groove formed between a pair of projected portions of the guide that are arranged with a predetermined space therebetween.

Figure 11:
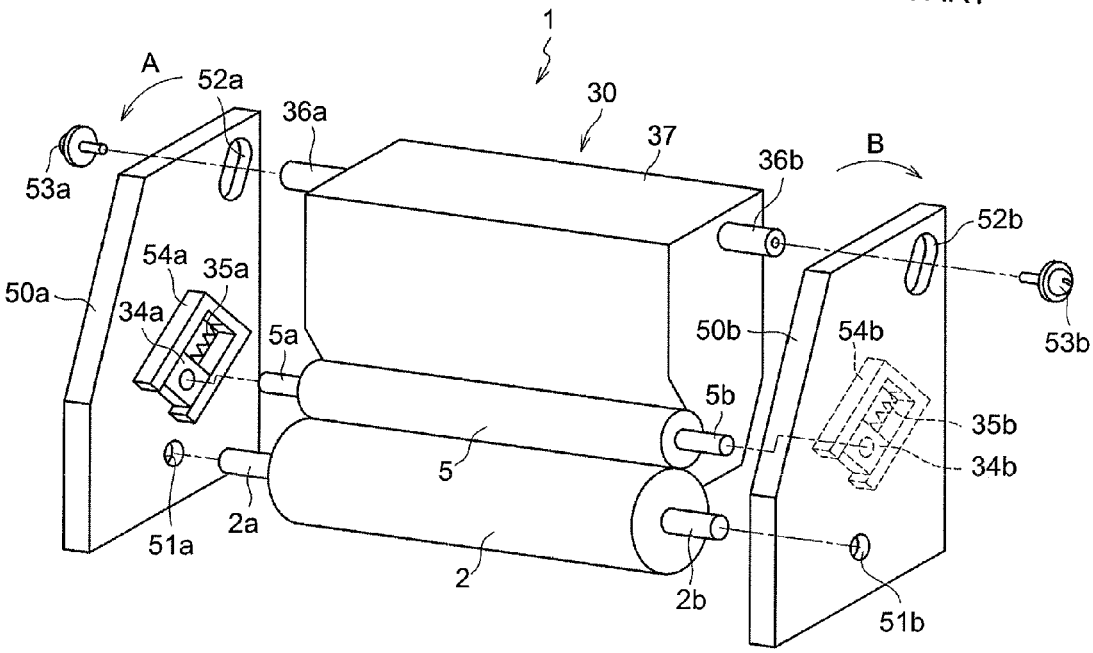
FIG.11 PRIOR ART
FIG. 11 is an exploded perspective view of the process unit.
Figure 12:
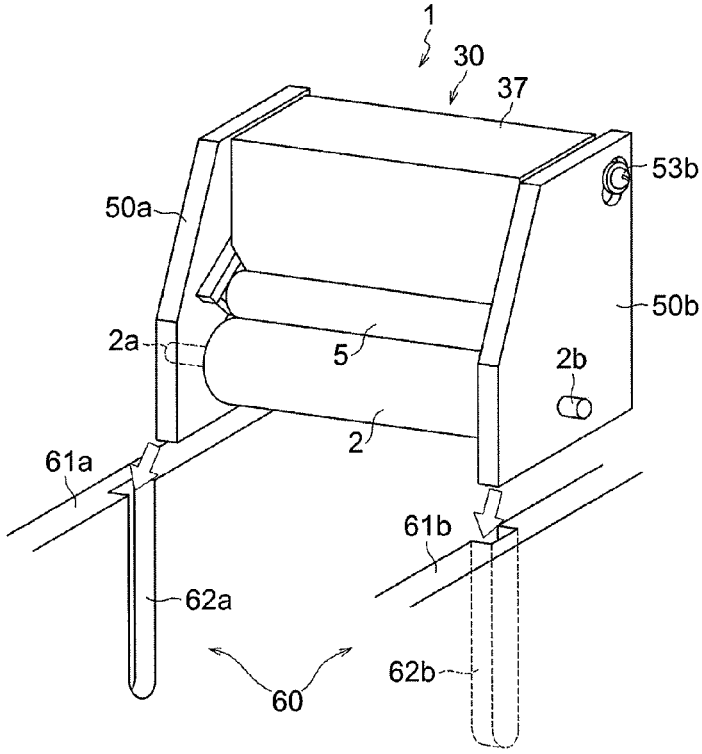
FIG.12 PRIOR ART
FIG. 12 is a schematic diagram for explaining a process of attaching the process unit to the main body of the image forming apparatus.
Figure 13:
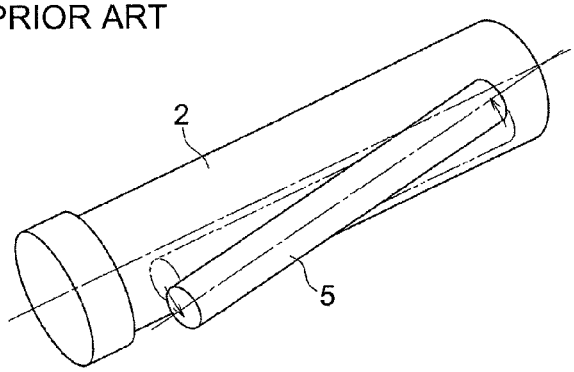
FIG.13 PRIOR ART
FIG. 13 is a perspective view for explaining a state of the developing roller that is tilted with respect to the image carrier according to the conventional technology.
Figure 14:
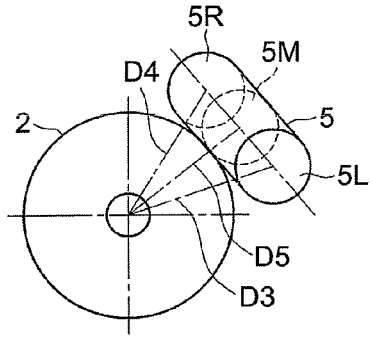
FIG. 14 is a side view of the developing roller and the image carrier from the axial direction of the image carrier for explaining states of the developing roller that is tilted with respect to the image carrier according to the conventional technology.

When the process unit is attached to the main body of the image forming apparatus, it is possible that the supporting members 50*a* and 50*b* are twisted with respect to each other in the directions indicated by the arrows A and B in FIG. 11 (on a plane in a direction perpendicular to the axis of the developing roller 5). Specifically, the supporting members 50*a* and 50*b* are circumferentially twisted around the rotation axis of the image carrier 2 in opposite directions to each other.

Figure 6:
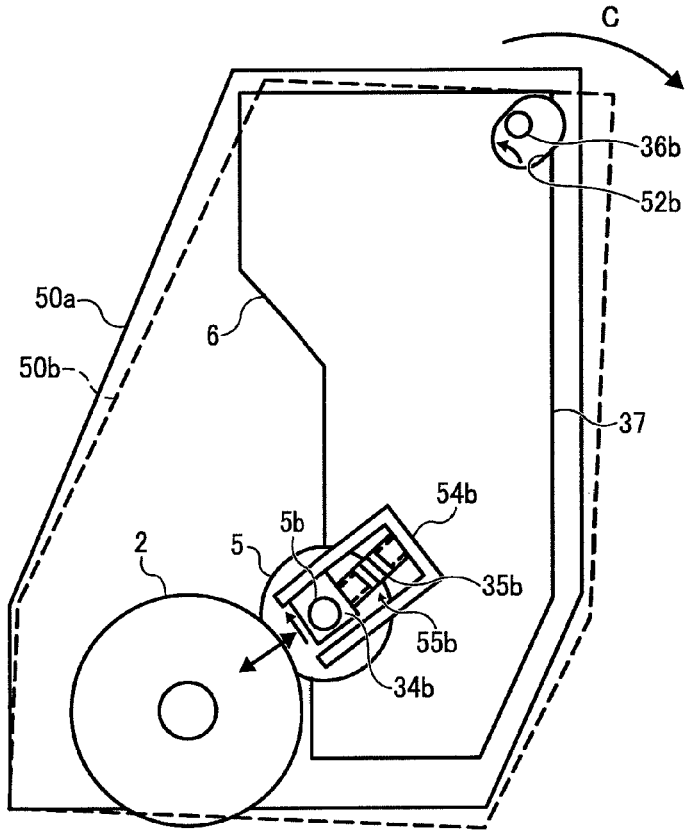
FIG. 6 is a side view of the supporting members that are twisted with respect to each other.

FIG. 6 is a side view of the supporting members 50*a* and 50*b* that are twisted with respect to each other. When the supporting member 50*b* is twisted with respect to the supporting member 50*a* around the rotation axis of the image carrier 2 in a direction indicated by an arrow C (in a circumferential direction), the projected portion 36*b* can be moved in the long hole 52*b* in a direction opposite to the direction indicated by the arrow C because of the space S' (see FIG. 5B) provided between the long hole 52*b* and the projected portion 36*b*. In this manner, the projected portion 36*b* is prevented from being moved with the twist of the supporting member 50*b*.

When the supporting member 50*b* is twisted with respect to the supporting member 50*a* in the direction indicated by the arrow C, the bearing 34*b* can be moved in the groove 55*b* in the direction opposite to the direction indicated by the arrow C because of the space S (see FIG. 5A) provided between the groove 55*b* and the bearing 34*b*. In this manner, the bearing 34*b* is prevented from being moved with the twist of the supporting member 50*b*.

As described above, the projected portion 36*b* and the bearing 34*b* are prevented from being moved with the twist of the supporting member 50*b*, so that it is possible to avoid the axis line of the developing roller 5 from being tilted with respect to the axis line of the image carrier 2.

When the supporting member 50*b* is twisted in the direction opposite to the direction indicated by the arrow C, the bearing 34*b* is moved in the groove 55*b* in the direction indicated by the arrow C and the projected portion 36*b* is also moved in the long hole 52*b* in the direction indicated by the arrow C. Specifically, as shown in FIGS. 5A and 5B, because the space S is provided on both sides of the bearing 34*a* and the space S' is provided on both sides of the projected portion 36*b*, even if the supporting members 50*a* and 50*b* are twisted in any directions, the bearing 34*b* and the projected portion 36*b* are not moved with the twist of the supporting member 50*b*.

If directions in which the supporting members 50*a* and 50*b* are twisted are identified, the spaces S and S' can be provided on one sides of the bearing 34*a* and the projected portion 36*b*.

An amount of twist between the supporting members 50*a* and 50*b* becomes larger at a position further away from the rotation axis of the image carrier 2. Therefore, an amount of twist at a position of the projected portion 36*b* is larger than that at a position of the bearing 34*b*. As shown in FIGS. 5A and 5B, because the space S' is set to be larger than the space S, it is possible to secure spaces for movement of the bearing 34*b* and the projected portion 36*b* in the circumferential direction corresponding to the amount of twist. Thus, the spaces S and S' can be set depending on an estimated amount of twist between the supporting members 50*a* and 50*b*.

Although it is explained in the above embodiment that the space S is provided between the bearing and the guide of one of the supporting members and the space S' is provided between the projected portion and the long hole of the same one of the supporting members, it is possible that the space S is provided between the bearing and the guide of one of the supporting members and the space S' is provided between the projected portion and the long hole of the other one of the supporting members.

Moreover, if the space S is provided between the bearing and the guide of each of the supporting members, each of the bearings can be moved in the corresponding groove in the circumferential direction. With this configuration, even if the amount of twist between the supporting members is large, it is possible to effectively prevent the developing roller from being tilted with respect to the image carrier.

Figure 7:
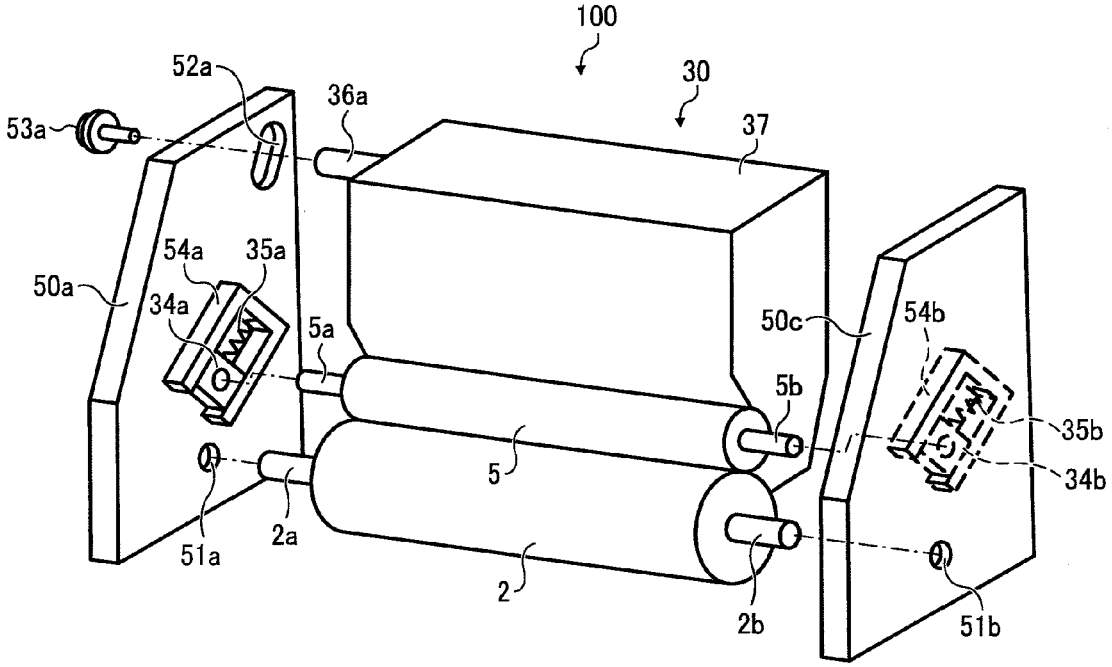
FIG. 7 is an exploded perspective view of a process unit according to another embodiment of the present invention.

FIG. 7 is an exploded perspective view of a process unit 100 according to another embodiment of the present invention. The projected portion 36*a* is arranged on one side of the main body 37, and the projected portion is not arranged on the other side of the main body 37. When the supporting member 50*a* and a supporting member 50*c* are twisted with respect to each other in the circumferential direction, the developing device 30 is moved with the twist of the supporting member 50*a* supporting the projected portion 36*a*, while the developing device 30 is not moved with the twist of the supporting member 50*c* because the developing device 30 is not supported by the supporting member 50*c*. Moreover, the space S (see FIG. 5A) is provided between at least one of the bearings 34*a* and 34*b* and the corresponding groove. With this configuration, the developing roller 5 is prevented from being moved with the twist between the supporting members 50*a* and 50*c*.

Figure 8:
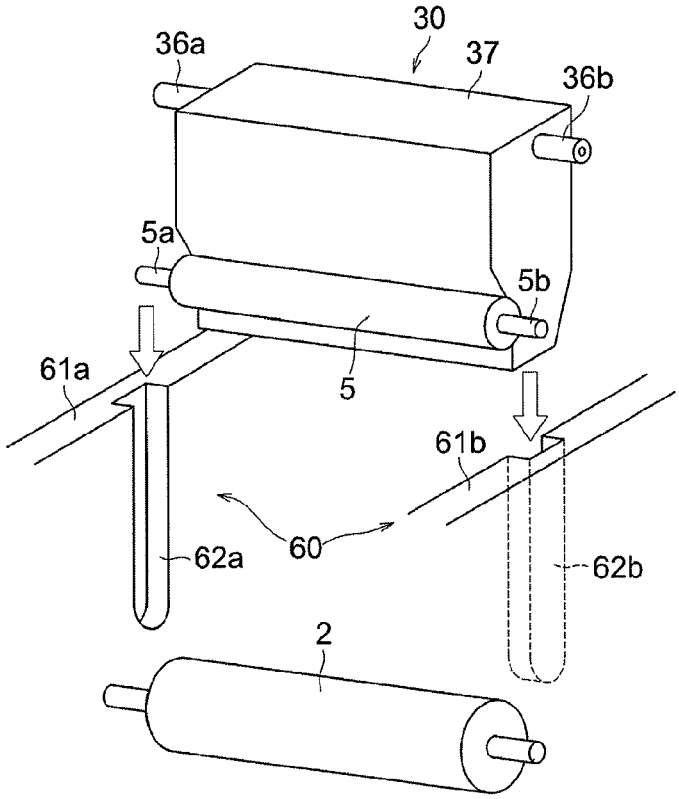
FIG. 8 is a schematic diagram for explaining a process of attaching a developing device to a main body of the image forming apparatus.

FIG. 8 is a schematic diagram for explaining a process of attaching the developing device 30 to the main body 60. The developing roller 5 is arranged on the lower portion of the main body 37. The projected portions 36*a* and 36*b* are arranged on the upper side surfaces of the main body 37. On the other hand, the grooves 62*a* and 62*b* are formed on the side walls 61*a* and 61*b* to attach the developing device 30 to the main body 60. The image carrier 2 is attached to the main body 60 at a position lower than the grooves 62*a* and 62*b*.

To attach the developing device 30 to the main body 60, the ends 5*a* and 5*b* and the projected portions 36*a* and 36*b* are inserted into the grooves 62*a* and 62*b*. When the ends 5*a* and 5*b* abut on the lower ends of the grooves 62*a* and 62*b*, respectively, the position of the developing roller 5 is set with respect to the image carrier 2 in an abutting manner.

With the configuration shown in FIG. 8, it is possible that the grooves 62*a* and 62*b* are twisted with respect to each other. Therefore, a width of the groove 62*a* is made large, so that the end 5*a* and the projected portion 36*a* that are inserted into the groove 62*a* can be moved in a direction that intersects the longitudinal direction of the groove 62*a*. Thus, it is possible to prevent the developing roller 5 from being tilted with respect to the image carrier 2 due to the twist between the grooves 62*a* and 62*b*. To set the position of the developing device 30, the end 5*b* and the projected portion 36*b* that are inserted into the groove 62*b* cannot be moved in the direction that intersects the longitudinal direction of the groove 62*b*.

The present invention is not limited to the above embodiments, but various modifications can be made without departing from the scope of the invention. For example, as shown in FIGS. 2 and 4, although the ends 5*a* and 5*b* are inserted into the grooves 55*a* and 55*b* via the bearings 34*a* and 34*b*, the ends 5*a* and 5*b* can be directly inserted into the grooves 55*a* and 55*b* without the bearings 34*a* and 34*b*.

In the above embodiments, although the case where the supporting members are circumferentially twisted around the rotation axis of the image carrier 2 in the opposite directions to each other is explained as an example, the present invention can be applied to a case where the supporting members are twisted in a direction other than the circumferential direction (a direction that intersects the first direction).

According to one aspect of the present invention, it is possible to prevent the axis line of the developing roller from being tilted with respect to the axis line of the image carrier. Thus, the developing roller and the image carrier can be arranged parallel to each other, and an image can be formed in a proper manner without the uneven image density or the image loss.

The process unit including the developing device and the image forming apparatus can achieve the same effect as that achieved by the developing device.

Even if the amount of twist between the supporting members is large, it is possible to effectively prevent the ends of the developing roller from being moved with the twist of the supporting members.

The main body of the developing device can be supported by the supporting members in a stable manner. If the supporting members are twisted with respect to each other, it is possible to prevent the projected portion arranged on one of the supporting members from being moved with the twist of the supporting members.

If the supporting members are twisted with respect to each other in any directions, it is possible to prevent the projected portion arranged on one of the supporting members from being moved with the twist of the supporting members.

In addition, it is possible to prevent the supporting members from being easily detached from the main body of the developing device. Thus, it is easier to handle the supporting members and the main body as a unit, and operability can be improved.

Moreover, the stability in supporting the main body by the supporting members is improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A developing device including a main body that is arranged between a pair of supporting members and includes a developing roller, wherein both end portions of the developing roller are supported by the supporting members, respectively, in a first direction in which the developing roller is movable toward and away from an image carrier, a groove is formed on each of the supporting members, either one of an end portion of the developing roller or a bearing that supports the end portion is inserted into the groove, a first space is provided between each of inner surfaces facing each other in a second direction intersecting the first direction of the groove that is formed on a first one of the supporting members and an outer surface of either one of at least one of the end portion of the developing roller or the bearing inserted into the groove that is formed on the first one of the supporting members, a second space is provided between each of inner surfaces facing each other in the second direction of the groove that is formed on a second one of the supporting members and an outer surface of either one of at least one of the end portion of the developing roller or the bearing inserted into the groove that is formed on the second one of the supporting members, and the first space is set to be smaller than the second space.

2. The developing device according to claim 1, wherein either one of the both end portions of the developing roller and both bearings is movable in the groove in the second direction.

3. The developing device according to claim 1, wherein one of the supporting members includes a long hole that extends in the first direction, and the main body includes a projected portion to be inserted through the long hole on its outer surface.

4. The developing device according to claim 1, wherein each of the supporting members includes a long hole extending in the first direction, the main body includes a pair of projected portions to be inserted into the long holes, respectively, on its outer surface, and one of the projected portions is movable in the long hole in the second direction.

5. The developing device according to claim 4, wherein a space is provided between inner surfaces of the long hole and an outer surface of the projected portion inserted into long hole.

6. The developing device according to claim 3 further comprising: a retaining member that is attached to an end of the projected portion inserted into the long hole for preventing the projected portion from being removed from the long hole.

7. The developing device according to claim 4 further comprising: a retaining member that is attached to an end of the projected portion inserted into the long hole for preventing the projected portion from being removed from the long hole.

8. The developing device according to claim 3, wherein the projected portion and a rotation axis of the developing roller are arranged close to opposite ends of the main body.

9. The developing device according to claim 4, wherein the projected portion and a rotation axis of the developing roller are arranged close to opposite ends of the main body.

10. A process unit comprising:

a pair of supporting members that is detachably attached to a main body of an image forming apparatus, wherein the supporting members integrally support a developing device and an image carrier, the developing device includes a main body that is arranged between the supporting members and that includes a developing roller, both end portions of the developing roller are supported by the supporting members, respectively, in a first direction in which the developing roller is movable toward and away from the image carrier, a groove is formed on each of the supporting members, either one of an end portion of the developing roller and a bearing that supports the end portion is inserted into the groove, and either one of at least one of the end portions of the developing roller and at least one of the bearings is movable in the groove in a second direction that intersects the first direction.

11. An image forming apparatus comprising:

a developing device including a main body that is arranged between a pair of supporting members and includes a developing roller, wherein both end portions of the developing roller are supported by the supporting members, respectively, in a first direction in which the developing roller is movable toward and away from an image carrier, a groove is formed on each of the supporting members, either one of an end portion of the developing roller or a bearing that supports the end portion is inserted into the groove, and a first space is provided between each of inner surfaces facing each other in a second direction intersecting the first direction of the groove that is formed on a first one of the supporting members and an outer surface of either one of at least one of the end portion of the developing roller or the bearing inserted into the groove that is formed on the first one of the supporting members, a second space is provided between each of inner surfaces facing each other in the second direction of the groove that is formed on a second one of the supporting members and an outer surface of either one of at least one of the end portion of the developing roller or the bearing inserted into the groove that is formed on the second one of the supporting members, and the first space is set to be smaller than the second space.

12. The developing device according to claim 1, wherein the first space is set to be minute.

13. The process unit according to claim 10, wherein a first space is provided between each of inner surfaces facing each other in a second direction intersecting the first direction of the groove that is formed on a first one of the supporting members and an outer surface of either one of at least one of the end portion of the developing roller or the bearing inserted into the groove that is formed on the first one of the supporting members, and wherein a second space is provided between each of inner surfaces facing each other in the second direction of the groove that is formed on a second one of the supporting members and an outer surface of either one of at least one of the end portion of the developing roller or the bearing inserted into the groove that is formed on the second one of the supporting members, and wherein the first space is set to be smaller than the second space.

14. The process unit according to claim 13, wherein the first space is set to be minute.

15. The apparatus according to claim 11, wherein the first space is set to be minute.

* * * * *